United States Patent [19]

Schlicht et al.

[11] Patent Number: 4,965,004

[45] **Date of Patent: * Oct. 23, 1990**

[54] PROCESS FOR A BORATED DETERGENT ADDITIVE

[75] Inventors: Raymond C. Schlicht, Fishkill, N.Y.; William J. Powers, III, Port Arthur, Tex.

[73] Assignee: Texaco Inc., White Plains, N.Y.

[ * ] Notice: The portion of the term of this patent subsequent to Oct. 23, 2007 has been disclaimed.

[21] Appl. No.: 342,136

[22] Filed: Apr. 21, 1989

[51] Int. Cl.[5] ..... C10M 135/10

[52] U.S. Cl. ..... 252/38; 252/33; 252/33.4; 252/39; 252/41

[58] Field of Search ..... 252/38, 39, 41, 33, 252/33.4

[56] References Cited

U.S. PATENT DOCUMENTS

| | | | |
|---|---|---|---|
| 3,480,548 | 11/1960 | Hellmuth | 252/33.4 |
| 3,679,584 | 7/1972 | Hellmuth | 252/33.4 |
| 3,829,381 | 8/1974 | LeSuer | 252/33.4 |
| 3,907,691 | 9/1975 | King | 252/33 X |
| 3,929,650 | 12/1975 | King | 252/33 X |
| 4,539,126 | 9/1985 | Bleeker | 252/39 |
| 4,560,489 | 12/1985 | Muir | 252/18 X |
| 4,683,126 | 7/1987 | Inoue | 252/18 X |

*Primary Examiner*—Olik Chaudhuri
*Assistant Examiner*—James M. Hunter, Jr.
*Attorney, Agent, or Firm*—Robert A. Kulason; James J. O'Loughlin; Vincent A. Mallare

[57] ABSTRACT

A process for preparing a borated, overbased metal detergent additive for lubricants which comprises borating an overbased metal salt in the presence of a protic solvent, distilling the borated metal salt mixture to remove protic solvent and water therefrom, cooling the distilled borated mixture, filtering the cooled borated mixture, stripping the cooled filtrate and recovering the borated metal detergent additive.

10 Claims, No Drawings

PROCESS FOR A BORATED DETERGENT ADDITIVE

BACKGROUND OF THE INVENTION

Field of the Invention

This invention relates to lubricating oils containing borated detergent additives which inhibit rust corrosion and deposits of fuels and lubricating oils resulting from the accumulation in engines of the oxidation anc degradation products. More specifically, this invention relates to an improved process for preparing borated detergent additives for use in lubricants.

When mineral lubricating oils are employed a crankcase lubricants in internal combustion engines, fuel and lubricant oxidation and degradation products accumulate in the lubricant and impinge on the engine surfaces with the resultant formation of gums, sludges which clog the oil feed lines and varnish-like deposits on the surfaces of rings, pistons, cylinders and other engine parts. Further, with emission control devices being installed on the presently manufactured automotive vehicles, some of the corrosive bodies of the engine exhaust system are introduced into the crankcase oil. The gums and sludges lead to piston sticking and varnish on the cylinder walls. This, coupled with the attack of the corrosive bodies on the engine metal surfaces, cause substantial deterioration of the engine operation.

Thus, it is an object of the present invention to counteract these negative factors of lubricants by providing additives for crankcase oils in small amounts such as dispersants and detergents to counteract the formation of gums and sludges and anticorrosives to inhibit the corrosive action of the exhaust gases introduced into the crankcase system, as well as rust inhibitors to prevent rust formation on engine metal parts.

DISCLOSURE STATEMENT

U.S. Pat. No. 3,480,548 discloses a process for preparing a borated, overbased metal detergent which process utilizes an overbased metal detergent in reaction with boric acid at a very high temperature of 150°–175° C.

U.S. Pat. No. 3,679,584 discloses a process based on that of U.S. Pat. No. 3,480,548 to prepare a borated intermediate which is subsequently overbased further.

U.S. Pat. No. 3,829,381 discloses a process similar to that of U.S. Pat. No. 3,480,548 where an overbased metal detergent is produced.

U.S Patent 3,909,691 discloses a borated overbased alkaline earth metal sulfonate prepared by a process similar to U.S. Pat. No. 3,480,548 where the overbased earth metal sulfonate is then treated with an alkali metal base.

U.S. Pat. No. 4,683,126 discloses an alkaline earth metal borate dispersion in a sulfonate by in situ reaction of a metal oxide or hydroxide with boric acid in the presence of water and a hydrocarbon solvent.

U.S. Ser. No. 833,689 discloses a lubricating oil composition which has improved properties of inhibiting rust, corrosive and deposit formation. The improved properties are imparted by the addition of minor amounts of a metal salt of an alkenylsuccinamic acid.

SUMMARY OF THE INVENTION

The present invention lubricating oil compositions which have improved oxidation resistance as well as rust, corrosion and deposit formation inhibiting properties comprise a major portion of a base oil of lubricating viscosity and a minor effective rust/corrosion inhibiting amount of a borated detergent additive prepared by an improved process comprising:

(a) adding a borating agent to an overbased metal salt in the presence of a protic solvent and a hydrocarbon solvent and reacting such mixture for a period of about 0.25 to about 5.0 hours at a temperature ranging from about 15° C. to about 100° C.;

(b) heating the borated metal salt mixture at a temperature sufficiently high to distill an amount of equal at least up to 80 percent of the protic solvent fed;

(c) cooling the distilled borated mixture to below the boiling point of the remaining solvent and filtering said cooled filtrate mixture; and (d) stripping the cooled distilled filtrate mixture under a pressure ranging from about 10 to about 200 mm Hg at a temperature ranging from about 20° C. to about 150° C., thereby recovering the borated metal detergent additive.

DETAILED DESCRIPTION OF THE INVENTION

The lubricating oil composition of this invention have improved oxidation resistance as well as rust and corrosion inhibiting properties and deposits reducing properties in either automative or diesel engines or their respective oil crankcases.

The present lubricating oil compositions comprises a major portion of a base oil of lubricating viscosity and minor effective rust/corrosion deposits inhibiting amount of a borated detergent additive where the borated detergent additive is prepared by the process comprising:

(a) adding a borating agent to an overbased metal salt in the presence of a protic solvent and a hydrocarbon solvent and reacting such mixture for a period of about 0.25 to about 5.0 hours at a temperature ranging from about 15° C. to about 100° C.;

(b) heating the borated metal salt mixture at a temperature sufficiently high to distill an amount of distillate equal to at least about 80 percent of the protic solvent fed;

(c) cooling the distilled borated mixture to below the boiling point of the remaining solvent and filtering said cooled filtrate mixture; and (d) stripping the cooled distilled filtrate mixture under a pressure ranging from about 10 to about 200 mm Hg at a temperature ranging from about 20° C. to about 150° C., thereby recovering the borated metal detergent additive.

The borated overbased metal salt of this invention may be selected from the groups of metal salts of the metals lithium, sodium, potassium, calcium, barium and magnesium, consisting of mineral oil sulfonates, ($C_{12}$–$C_{50}$) alkyl sulfonates, ($C_{12}$–$C_{50}$) aryl sulfonates, ($C_{12}$–$C_{50}$) alkenyl sulfonates, ($C_{12}$–$C_{50}$) alkylphenol sulfonates, ($C_{12}$–$C_{50}$) alkyl salicylates, ($C_{12}$–$C_{50}$) alkylphenates, sulfur-coupled ($C_{12}$–$C_{50}$) alkylphenates, amino bis-($C_1$–$C_{10}$) alkylene-coupled ($C_{12}$–$C_{50}$) alkylphenates, ($C_1$–$C_{10}$) alkylene-coupled ($C_{12}$–$C_{50}$) alkanecarboxylates, ($C_{12}$–$C_{50}$)-alkenylsuccinamates, ($C_{12}$–$C_{50}$) alkane or olefin oxidates, ($C_{12}$–$C_{50}$)-alkylaryl carboxylates.

The preferred overbased metal detergent salts according to the present invention are provided below in Table I.

TABLE I

Preferred Overbased Metal Detergent Salts

1. Calcium, magnesium or sodium salts of a sulfonated mineral oil feedstock, where the fraction of the oil feedstock which is sulfonated, provides a metal sulfonate which has an average equivalent weight ranging from 350 to 800, preferably 400 to 500. The above salts are normally employed as 20–80 percent active ingredient in a mineral oil diluent.

2. Calcium, magnesium or sodium salts of a sulfonated alkylated aromatic feedstock where the aromatic compound may be benzene, toluene, xylene or napthalene and which is alkylated with one or more ($C_{12}$–$C_{30}$)-alkyl groups derived from straight or branched chain olefins or alkyl halides. The preferred feedstocks are ($C_{12}$–$C_{18}$)-linear olefin-alkylated benzene, ($C_{12}$–$C_{18}$)-polypropylene-alkylated benzene or ($C_{12}$–$C_{24}$)-polybutylene-alkylated benzene; these may be mono- or dialkylated or mixed mono-dialkylated benzene. The preferred metal sulfonate has an average equivalent weight of 350–800 and may be employed in the form of a 20–80 percent active ingredient in a mineral oil diluent.

3. Calcium, magnesium or sodium sulfonates which are comprised of mixtures of mineral oil suifonates and alkylated aromatic sulfonates ranging from 20–90 percent mineral oil sulfonate component, preferably 40–60 percent. These sulfonates may also be employed in the form of 20–80 percent active ingredient in a mineral oil diluent.

4. Calcium, magnesium or sodium sulfurized alkylphenates where the alkyl groups may be ($C_{12}$–$C_{30}$), either linear or branched. These alkylphenates may be employed in the form of 20–80 percent active ingredient in a mineral oil diluent.

5. Calcium, magnesium or sodium alkenyl succinamates prepared by neutralization of a reaction product of a ($C_{24}$–$C_{50}$) alkenylsuccinic acid anhydride (ASAA) with a primary or secondary amine. The preferred alkenylsuccinamates may be prepared from 400–800 average molecular weight ASAA and a secondary amine such as morpholine, diethanolamine, dimethylamine or N-methylaniline.

The hydrocarbon solvent which may be used in the present prooess may be selected from the group consisting of n-pentane, n-hexane, cyclohexane, n-heptane, n-octane, isoctane, n-decane, benzene, toluene, xylene and mixtures thereof. Preferably, the hydrocarbon solvent is a ($C_6$–$C_8$) aliphatic hydrocarbon.

The protic solvent used in this process may be selected from the group consisting of ($C_1$–$C_5$) alcohols, glycols, glycol monoethers, water and mixtures thereof.

According to the present process, the metal salt contains a diluent oil consisting essentially of a mineral oil or synthetic oil having a kinematic viscosity of about 15 to about 40 cs at 40° C.

The borating agent used in the present process may be boric acid or boric oxide. The borating agent is added to the solution of the overbased metal salt in the reaction solvents at a temperature ranging from about 20° C. to about 60° C. Then the reaction mixture is heated to a maximum temperature equal to the reflux temperature of the solvent mixture for a period of about 0 to about 4.0 hours before a major portion of the polar solvent and water are distilled therefrom. After the solvent and water are distilled off, the distilled borated mixture is cooled to a temperature ranging from about 80° to about 20° C. After being filtered, the cooled distilled borated mixture is stripped under atmospheric or sub-atmospheric pressure at a temperature ranging from about 80° C. to about 180° C. or preferably at a reduced pressure of about 10 to about 200 mmHg at a temperature ranging from about 20° C. to about 150° C.

Overbased metal sulfonate detergents are well known to those skilled in lubricant additive manufacture and use. A certain sub-class of such detergents, borated overbased metal sulfonates, are favored in some applications since the boration of the metal base has been shown to significantly reduce the normally pro-oxidant effect of overbased sulfonates and may also reduce deposits formation, rust and wear in engines. Borated overbased metal sulfonates, such as borated overbased calcium sulfonates, can be prepared by procedures such as that disclosed in the copending application, Ser. No. 07/342,137, which employs unfinished reaction mixtures which still contain the solvents used in that step (methanol and heptane); the former, plar solvent dissolves the boric acid and causes its homogenoeus reaction with the metal base at moderate temperatures. Working with a similar process in which a finished overbased metal sulfonate is reacted with boric acid in the presence of a lower alcohol, such as (methanol) and an inert solvent (such as heptane), we have discovered that the manner in which the boration process is conducted is unexpectedly critical to the fluidity and oil solubility of the final product. This point is best demonstrated by the examples provided below.

The present invention is an improved process for the preparation of borated, overbased metal detergents which incorporates a low temperature boration step in the presence of a polar solvent and an inert hydrocarbon solvent. This process differs from the closest prior art (U.S. Pat. No. 3,480,548) which employs an overbased metal detergent (a $CaCo_3$-overbased calcium sulfonate) in reaction with boric acid or other borating agent at a very high temperature (150°–175° C.) in the absence of solvents This results in the vigorous evolution of $CO_2$ and water which causes severe foaming problems and therefore necessitates the slow, gradual addition of the boric acid.

The present invention is improved over the closest prior art (U.S. Pat. No. 3,480,548) in that (a) the boric is added over less than 0.5 hr (vs. 1.5 hr for U.S. Pat. No. 3,480,548) and reacts at lower temperatures about 100° C. in the presence of a protic and a hydrocarbon solvent; this results in greater processing ease since there is only minimal foaming (only $CO_2$ is evolved as a gas at this stage), (b) the boric acid is dissolved by the protic solvent resulting in an efficient uptake of boron into the product, (c) filtration carried out at lower more convenient temperatures in a hydrocarbon solvent and (d) overall shorter reaction times result in improved economics.

The present processes may be applied to the boration of various types of overbased detergents such as metal sulfonates, salicylates, alkenylsuccinamates, phenolates, phenolates coupled with oxygen, sulfur, thio-or oxybisalkylene, imino-or other amino (di-, tri, etc.) bis-alkylene groups which are overbased with metal oxides, hydroxides, alkoxides, carbonates, sulfites or sulfides. The metals may be alkali, alkaline earth or other metals. The preferred detergents are alkaline earth metal sulfonates overbased with alkaline earth or alkali hydroxides and/or carbonates. The preferred metals are calcium, magnesium, lithium and sodium. The ratio of borating agent to dispersed inorganic base may range from 0.1–10 mole ratio with 0.5–3 being preferred and 0.2–2 being especially preferred. The products of the present processes are useful as detergent additives in lubricants and fuels where they may protect the engines and peripheral equipment from rust, corrosion and engine deposits as well as protect the fluids from oxidative degradation.

The following examples illustrate the processes for preparing the borated overbased detergents of the present invention and their advantages over the prior act processes.

According to the present invention, an overbased calcium sulfonate, exhibiting a Total Base Number (TBN, as may be measured by ASTM D 2896) of about 250 to about 500, which may be prepared by a number of different processes familiar to those skilled in the art is caused to dissolve in a petroleum naphtha. The preferred solvent is a distillate fraction boiling from about 170° F. to about 220° F. Such distillates are widely available commercially and known as refinery heptanes, crude heptane, etc. A low molecular weight alcohol, preferably methanol, is added as a reaction promoter and cosolvent. The solution is stirred mechanically, preferably under an inert gas blanket, and boric acid is sifted in over a 1–3 hour period. We have found that commercial technical grade boric acid gives acceptable results although higher purity material may be used. External heat is applied and the reaction mixture is heated to boiling. The mixture may optionally be boiled under total reflux. We prefer to include a nominal one hour total reflux step. Azeotropic removal of aqueous methanol has been determined to be a critical step as can readily be seen from the data in the table below. Details are discussed in the several specific examples given. After cessation of azeotropic removal of aqueous methanol, the material is cooled to a temperature below the boiling point and filtered through a pad of diatomaceous earth. The filtrate is then stripped in vacuo to recover solvent and isolate the borated overbased sulfonate detergent. In the particular experiments referred to in the following table, we conducted this vacuum stripping step in a rotating vacuum (ca. 50 mm Hg) evaporator, heating the material being stripped using an oil bath maintained at a temperature of 250° F. A 12 hour stripping period is employed.

The advantages of the present invention are illustrated by the examples provided below.

EXAMPLES A AND B

In both of these examples, preparation of a borated overbased calcium sulfonate was attempted according to the procedure outlined above. In Example B, a one-hour total reflux period was employed prior to the azeotropic removal of aqueous methanol. No total reflux period was employed in Example A. In both cases, the amount of azeotropic overhead separated and collected was approximately 60 wt. % of the amount of methanol charged. The borated overbased sulfonate, isolated after filtrantion and stripping as described above, was stiff and gelatinous in nature.

EXAMPLES C AND D

In both of these examples, preparation of a borated overbased calcium sulfonate was attempted according to the procedure outline above. In both examples, a one-hour total reflux period was employed prior to the azeotropic removal of aqueous methanol. Minor differences in solvent amount from those employed in Examples A and B were employed. Azeotropic removal and separation of aqueous methanol was carried out to the point that the weight of the separated overhead was essentially equal to the amount of the methanol charged. The borated overbased sulfonates isolated after filtration and stripping as described above were viscous liquids at ambient temperatures and exhibited kinematic viscosities of 200–260 cSt at 100° C.

EXAMPLE E

In order to test our idea on the extent of the amount of azeotropic aqueous methanol removal, an experiment was conducted wherein the amount of charged ingredients was identical to that in Example B (where the product was a gel), but conditions were manipulated to assure that the amount of azeotropically removed aqueous methanol exceeded the weight of the methanol charged, the product was a viscous liquid.

While it would be expected that it would be necessary to remove the methanol cosolvent and water of reaction from the crude boration product in order to render the composition made in this process useful in lubricant formulation, it is surprising and unexpected that the means of removal would be so large an effect on product properties. In Examples A and B, the aqueous methanol was essentially completely removed by the vacuum stripping step described in the procedure above. Thus, removal of protic solvents is not, in itself, sufficient to make a useful product. Use of the method and extent of protic medium removal as discussed herein is critical. In the practice of our disclosure, the mass of protic solvent should be at equal to 80 percent of the amount of alcohol cosolvent charted and azeotropic removal can be extended to the theoretical limit. Our preferred range of operation would be to azeotropically remove and amount of protic solvent amounting from 90 to 120 wt. % of the alcohol charged.

The results of significance from the preceeding examples are provided below in Table I.

The significance of these examples are that the degree of removal of the protic solvent at atmospheric pressure (Step B of the process) has a totally unexpected and important effect on the fluidity of the final solvent-free product. The fluid products resulting from the subject process (s in Examples C, D and E) may be handled more conveniently and are easily blended into lubricant compositions while the gels of Examples A and B are unsuitable. The lower viscosities of products C and D, compared to product E, indicate that subtle variations in the subject process also have a profound effect on the fluidity of the products.

TABLE I

| | SUMMARY OF RESULTS | | | | |
|---|---|---|---|---|---|
| RUN | A | B | C | D | E |
| Charge Weights, grams | | | | | |
| Heptane | 1360 | 1360 | 1610 | 1360 | 1360 |
| Boric Acid | 432 | 432 | 432 | 432 | 432 |

TABLE I-continued

| RUN | SUMMARY OF RESULTS A | B | C | D | E |
|---|---|---|---|---|---|
| Overbased Sulfonate, 360 TBN | 2247 | 2247 | 2247 | 2247 | 2247 |
| Methanol | 242 | 242 | 240 | 160 | 240 |
| Conditions | | | | | |
| Boric Acid/Overbased Sulfate, Molar | 1/1 | 1/1 | 1/1 | 1/1 | 1/1 |
| Boric Acid Charge, HRS | 0.8 | 1.0 | 1.0 | NR | 1.0 |
| Reflux Period, HRS | none | 1.0 | 1.0 | 1.0 | 1.0 |
| Temp Range, °F. | — | 146–150 | 149–150 | 152 | 148–150 |
| Aqueous MeOH Removal, HRS | 3.5 | 3.5 | 3.5 | 3.5 | 3.6 |
| Temp Range, °F. | 150–151 | 150–157 | 150–181 | 152–186 | 150–213 |
| Crude Prod, GMS | 4405 | 3859 | 4185 | 3952 | 3875 |
| Overhead, GMS | 134 | 148 | 244 | 161 | 312 |
| Filtration–1500 ML Crude Product 750 ML Heptane as Cake Wash | | | | | |
| Time Required, min | 2 | 2 | 2 | 3 | 2 |
| Filtrate, GMS | 1830 | 1504 | 1819 | 1820 | 1826 |
| Cake, GMS | 76 | 66 | 76 | 103 | 70 |
| Stripped Product wt. GMS | NR | 765 | 905 | 879 | 913 |
| TBN | 306 | 292 | 307 | 300 | 304 |
| KIN VISC. 100C cSt | GEL | GEL | 253.7 | 213 | 912 |

We claim:

1. A process for preparing a borated, overbased oil-soluble metal detergent additive for lubricants, said process comprising:

(a) adding a borating agent to an overbased metal salt in the presence of a protic solvent and a hydrocarbon solvent and reacting for a period of 0.25 to about 5.0 hours at a temperature ranging from about 15° C. to about 100° C.;

(b) heating said borated metal salt mixture at a temperature sufficiently high to distill an amount of distillate equal to at least about 80 percent of the protic solvent fed;

(c) cooling the distilled borated mixture to below the boiling point of the remaining solvent and filtering said cooled distilled mixture; and (d) stripping the cooled distilled filtrate mixture under a reduced pressure ranging from about 10 to about 200 mm Hg. at a temperature ranging from about 20° to about 150° C., and recovering the borated metal detergent additive.

2. The process of claim 1 wherein the metal salt is selected from the group of salts of the metals of lithium, sodium, potassium, calcium, barium and magnesium.

3. The process of claim 1 wherein said overbased metal salt is selected from the group consisting of overbased lithium, Ca, Ba, Na, K, and Mg salts.

4. The process according to claim 1 wherien the hydrocarbon solvent is selected from the group consisting of n-pentane, n-hexane, cyclohexane, n-hepetane, n-octane, isoctane, n-decane, benzene, toluene, xylene and mixtures thereof.

5. The process of claim 1 wherein said protic solvent is selected from the group consisting of ($C_1$–$C_5$) alcohols, glycols, glycol monoethers, water and mixtures thereof.

6. The process of claim 1 wherein the metal salt contains a diluent oil consisting essentially of a mineral oil or synthetic oil having a kinematic viscosity of about 15 to about 40 cs at 40° C.

7. The process of claim 1 wherein the amount of distillate removed is about equal to the amount of protic solvent fed.

8. The process of claim 1 wherein the borating agent is added to the solution of overbased metal salt at a temperature ranging from about 20° to about 60° C.

9. The process of claim 8 wherein the borating agent is boric acid or boric oxide.

10. The process of claim 1 whrein the metal salt is selected from the group of salts consisting of mineral oil sulfonates, ($C_{12}$–$C_{50}$) alkyl sulfonates, ($C_{12}$–$C_{50}$) aryl sulfonates, ($C_{12}$–$C_{50}$) alkenyl sulfonates, ($C_{12}$–$C_{50}$) alkylphenol sulfonates, ($C_{12}$–$C_{50}$) alkyl salicylates, ($C_{12}$–$C_{50}$) alkylphenates, sulfur-coupled ($C_{12}$–$C_{50}$) alkylphenates, amino bis- ($C_1$–$C_{10}$) alkylene-coupled ($C_{12}$–$C_{50}$) alkylphenates, ($C_1$–$C_{10}$) alkylene-coupled ($C_{12}$–$C_{50}$) alkylphenates, ($C_{12}$–$C_{50}$) alkanecarboxylates, ($C_{12}$–$C_{50}$) alkenylsuccinamates, ($C_{12}$–$C_{50}$) alkane or olefin oxidates and ($C_{12}$–$C_{50}$) alkylaryl carboxylates.

* * * * *